US007331289B2

(12) United States Patent
Albrecht et al.

(10) Patent No.: US 7,331,289 B2
(45) Date of Patent: Feb. 19, 2008

(54) MODULAR SHEET-FED ROTARY PRINTING PRESS

(75) Inventors: Kai Albrecht, Heidelberg (DE); Jochen Bechtler, Malsch (DE); Holger Faulhammer, Stuttgart (DE); Michael Krüger, Edingen-Neckarhausen (DE); Helmut Meyer, Wiesloch (DE); Detlef Strunk, Heidelberg (DE)

(73) Assignee: Hèidelberger Druckmaschinen AG, Heidelberg (DE)

( * ) Notice: Subject to any disclaimer, the term of this patent is extended or adjusted under 35 U.S.C. 154(b) by 89 days.

(21) Appl. No.: 11/007,999

(22) Filed: Dec. 9, 2004

(65) Prior Publication Data

US 2005/0120901 A1 Jun. 9, 2005

(30) Foreign Application Priority Data

Dec. 9, 2003 (DE) ..... 103 57 429

(51) Int. Cl.
*B41F 33/00* (2006.01)

(52) U.S. Cl. ..... 101/484; 101/480

(58) Field of Classification Search ..... 101/480, 101/483, 484, 116; 358/1.1, 1.15, 296, 449; 710/107; 399/370
See application file for complete search history.

(56) References Cited

U.S. PATENT DOCUMENTS

| | | | | | |
|---|---|---|---|---|---|
| 4,366,542 | A * | 12/1982 | Anselrode | 700/125 |
| 4,858,138 | A * | 8/1989 | Talmadge | 705/408 |
| 4,870,611 | A * | 9/1989 | Martin et al. | 715/526 |
| 5,075,786 | A * | 12/1991 | Ikenoue et al. | 358/449 |
| 5,125,098 | A * | 6/1992 | Burrows | 711/108 |
| 5,327,833 | A * | 7/1994 | Danielson | 101/484 |
| 5,461,469 | A * | 10/1995 | Farrell et al. | 399/407 |
| 5,646,740 | A | 7/1997 | Webster et al. | 358/296 |
| 5,664,101 | A * | 9/1997 | Picache | 709/250 |
| 5,694,529 | A | 12/1997 | Fromherz | 358/1.15 |
| 5,828,937 | A * | 10/1998 | Aerens et al. | 399/301 |
| 6,041,705 | A | 3/2000 | Lintner | 101/116 |
| 6,622,624 | B1 | 9/2003 | Divine et al. | 101/484 |
| 6,701,836 | B2 | 3/2004 | Sommer | 101/183 |
| 6,748,340 | B2 * | 6/2004 | Otsuki et al. | 702/150 |
| 7,027,187 | B1 * | 4/2006 | Zuber | 358/1.9 |
| 7,199,886 | B2 * | 4/2007 | Brandl | 358/1.13 |
| 2002/0069256 | A1 * | 6/2002 | Benja-Athon | 709/217 |
| 2002/0099889 | A1 | 7/2002 | Grimm et al. | 710/107 |
| 2003/0234950 | A1 * | 12/2003 | Lay | 358/1.14 |
| 2004/0212651 | A1 * | 10/2004 | Johnson et al. | 347/19 |

FOREIGN PATENT DOCUMENTS

| | | |
|---|---|---|
| DE | 37 30 625 A1 | 3/1989 |
| DE | 195 09 947 A1 | 9/1996 |
| DE | 196 26 821 A1 | 1/1998 |
| DE | 102 08 791 A1 | 9/2002 |

(Continued)

*Primary Examiner*—Anthony H. Nguyen
(74) *Attorney, Agent, or Firm*—Laurence A. Greenberg; Werner H. Stemer; Ralph E. Locher

(57) ABSTRACT

A module for a machine for processing sheet printing materials, has interfaces for control communication, a memory unit which can be read and written and which contains the properties of the module, and also a communications device which is used for communication with further modules and/or a higher-order control system of the machine. The communications device is operatively connected to the memory unit.

17 Claims, 3 Drawing Sheets

FOREIGN PATENT DOCUMENTS

| | | | |
|---|---|---|---|
| EP | 0 747 790 | B1 | 12/1996 |
| EP | 0 778 523 | A2 | 6/1997 |
| EP | 0 878 303 | A2 | 11/1998 |
| EP | 1 147 893 | A2 | 10/2001 |
| EP | 1 172 204 | A1 | 1/2002 |
| GB | 2 209 853 | A | 5/1989 |

* cited by examiner

MODULAR SHEET-FED ROTARY PRINTING PRESS

BACKGROUND OF THE INVENTION

Field of the Invention

The invention lies in the field of printing machines and printing technology. More specifically, the present invention relates to a module for a machine for processing sheet printing materials, for example a sheet-fed rotary printing press.

A sheet-fed rotary printing press of the general kind is described in European published, prosecuted application EP 1 147 893 A2. The printing press comprises a sheet feeder, a sheet delivery and a plurality of substantially identically constructed basic modules arranged between them, which constitute the individual printing units of the sheet-fed rotary printing press. In EP 1 147 893 A2 the printing units are designated basic modules, which can be supplemented by a so-called multifunctional module. The multifunctional module is in that case arranged between the last basic module in the running direction and the delivery, this multifunctional module being provided to accommodate various additional devices. Such additional devices can be driers, foundering devices, punching devices and so on. No indications as to how to drive the individual basic modules and to control the same can be gathered from the published document. In particular, it does not reveal what settings become necessary for the purpose of configuration following the assembly of the individual basic modules to form a sheet-fed rotary printing press.

European patent EP 0 747 790 B1 (corresponding to U.S. Pat. No. 5,694,529) discloses a copier which is of modular construction. In that case, the copier has a computer (CPU) which is capable of detecting individual components of the copier. Here, the system is capable of adapting its operating software on the basis of the components detected and of providing appropriate functionalities on this basis. The system in this case follows the "plug and play" concept, as it is known, so that the user merely has to plug the components into the copier but the configuration of the copier is carried out automatically. In this case, the individual modules have a description of their capabilities and functions, which can be transmitted to the central CPU of the copier. As a result, after the individual modules have been plugged into the copier, the CPU can detect which components have been added or removed.

While the European application EP 1 147 893 A2 is entirely silent with regard to the configuration and commissioning of a modularly constructed sheet-fed rotary printing press, the modularly constructed copier according to EP 0 747 790 B1 (corresponding to U.S. Pat. No. 5,694,529) follows a central approach. In the copier, the detection of the individual modules is carried out by the central computer (CPU) on its own, while the individual modules cannot communicate with one another. The copier should therefore also be called modular only in the sense of additionally insertable components. The actual copier with its copying unit and the central control computer (CPU) cannot be changed; it is merely possible for attached parts to be added.

In the case of the configuration of modular sheet-fed rotary printing presses, however, such a central approach proves to be inadequate, since here there is no central unchangeable unit, since in principle every printing unit or every other modular unit can assume every position in the machine.

SUMMARY OF THE INVENTION

It is accordingly an object of the invention to provide a modular sheet-fed rotary printing machine, which overcomes the above-mentioned disadvantages of the heretofore-known devices and methods of this general type and which provides modules for a sheet-fed rotary printing press that permit automatic commissioning and configuring of a sheet-fed rotary printing press comprising such modules.

With the foregoing and other objects in view there is provided, in accordance with the invention, a module for a machine for processing sheet printing materials, comprising:

interfaces for control communication;

a memory unit containing information concerning properties of the module and configured with read and write access; and a communications device, configured for communication with at least one of a further module and a higher-order control system of the machine, and operatively connected to said memory unit.

As compared with the prior art, the modules according to the invention are superior as a result of a memory unit which can be read and written and which is additionally connected to a communications device. The communications device is used to interchange data with a higher-order machine control system or to perform direct information interchange with further modules. By virtue of the memory unit and the communications device, in this way each module can be configured appropriately in accordance with its position in the sheet-fed rotary printing press; in addition both units can also undertake the control of the individual printing unit module. As a result, a sheet-fed rotary printing press can be expanded or shortened as desired, in that new modules are easily attached to modules already present or are connected between them or are removed. The modules which are then currently present can then interchange information about their capabilities via the communications device or, depending on the position of the individual module, can perform the appropriate settings in the module in order to obtain a serviceable sheet-fed rotary printing press.

In a first advantageous refinement of the invention, provision is made for the communications device to be suitable for interchanging data with further modules for the configuration of the machine. The communications device in the individual modules is needed not only for driving the individual modules during the operation of the press but, in particular, advantageously when the commissioning and configuration of the machine are concerned. In this case, the communications device can be used to transmit data directly to other modules for commissioning and also to receive data, so that the machine comprising a plurality of modules can configure itself automatically. In particular, in this case the positions of the individual printing unit modules can be communicated appropriately, it being possible for the manual entry of the individual printing unit positions by service personnel to be dispensed with. Furthermore, the modules can interchange data independently of a higher-order control system during normal printing operation, in order in this way to ensure the accurate angular synchronization of the individual printing modules.

Furthermore, provision is made for the module to have at least one standardized transport interface. In order to be able to join a plurality of modules together to form a serviceable sheet-fed rotary printing press or another sheet-processing machine, such as a modularly constructed folding machine, it is necessary for a trouble-free transfer of the sheets to be processed from one module to the next module to be possible. In order that the modules can be used flexibly, this transfer of individual sheets to an adjacent module must be possible without difficulty. This is served by a standardized transport interface which, for example, can comprise a sheet transfer cylinder whose grippers for picking up sheets are arranged in such a way that, when it is connected to an adjacent module, no collision with its grippers can occur during the sheet transfer. In this case, it is of course also necessary for the format widths of the cylinders of adjacent modules to agree. This standardized transfer naturally relates not just to printing unit modules but also to feeders, deliveries, varnishing units, and dryers and further processing modules, which likewise have the same standardized transport interface. These modules can thus be built up one after another in any desired order and transfer sheet printing materials to adjacent modules via the existing standardized transport interface. The transport interface can in this case be used both for sheet acceptance and also sheet transfer, but two separate interfaces for sheet acceptance and sheet transfer can also be present. These transport interfaces are in this case preferably constructed as sheet transfer drums, which accept the sheet from one printing unit module and discharge it to a further module. There can also be more than two transport interfaces per module, so that more than two modules can be attached to a module, in order for example to be able to produce a Y configuration. In this configuration, sheets are accepted at two interfaces on the module and are discharged to a further module via a third interface.

Furthermore, provision can be made for the module to have at least one interface for the power supply. This interface is preferably also standardized, so that the power supply can be provided without difficulty between various modules. If the power supply is provided electrically, each module has electric connectors via which the individual modules can be connected to one another. In this case, the electrical connection can be produced via an electric lead which connects the individual modules to one another, or the connectors on the modules are constructed in such a way that the modules can be plugged directly into one another. However, non-contact power transmission between individual modules is also possible without difficulty, since the modules stand beside one another without any gaps or at least at a quite small distance. A non-contact power supply can be implemented inductively or capacitively.

Provision is advantageously made for the module to have a dedicated drive motor. This drive motor can be an electric motor, but hydraulic or pneumatic drive units can also be used. If the module has a dedicated drive motor, then the module merely needs connections for the power supply and for the control of the module. The individual modules then do not need to be connected to one another via drive couplings, in order for example to produce a closed gear train between the individual printing unit modules as in the case of conventional sheet-fed presses. As a result of the dedicated drive motor in each module, a sheet-fed rotary printing press assembled from these modules automatically has individual drives. This therefore provides maximum flexibility when assembling the modules. Since the sheet printing materials have to be transported in accurate register through the machine comprising modules, any register deviations can also be corrected by means of the dedicated drive motors, if the motors are driven appropriately. In addition, the drive motors can be used for the purpose of making the commissioning of the modular machine easier, in that the drive motors move the respective module into a position such that the machine is immediately ready for accurate-register printing.

In addition or as an alternative to the embodiment having a dedicated drive motor, provision can be made for the module to have at least one drive interface. In the following text, a drive interface is understood to mean a device via which drive torques can be transmitted between individual modules. In this way, it is possible to synchronize modules with one another on the drive side, even mechanically. In addition, it is also possible to use modules which do not have dedicated drive motors and, instead, are driven concomitantly by adjacent modules. It is even conceivable here that, in a machine of modular construction, there has to be only one module with a dedicated drive motor, which then drives all the other modules without a dedicated drive motor via drive interfaces.

Provision is advantageously made for the drive interface to be a shaft end provided with a coupling. Modules which have a drive interface can in this way be connected to one another mechanically by means of a coupling, it being possible for a force-fitting coupling, for example an electromagnetic coupling, to be used instead of a pure form-fitting coupling. It is particularly advantageous if the coupling functions automatically, that is to say the couplings are engaged as soon as a module is attached to another module having a drive interface. A further possibility is for the couplings to engage only when the machine is configured. In the case of electrically, hydraulically or pneumatically driven couplings, this is possible via the control unit in the module.

In a further refinement of the invention, provision is made for there to be an automatic detection and configuration function. As soon as the individual modules are able to interchange data via their communications device, a detection and configuration program can run automatically, which coordinates the individual modules with one another and allocates appropriate functions to them corresponding to the respective position in the machine. In addition, such a detection and configuration program can of course also be started at the instigation of the service personnel by pressing a knob. In any case, the service personnel do not have to carry out the configuration themselves, since this job is taken from them by the modular machine. After the automatic detection and configuration program has been carried out, the machine is then released for operation.

Furthermore, provision can be made for the module to have a connection for attachment to a data bus system. A suitable data bus is, for example, a CAN bus, via which the individual modules can communicate with one another. The CAN bus can also be used as a control bus, via which rotational speed or angle set points for the drives of the individual modules can be predefined between the individual modules and a higher-order control computer. By means of the bus system, the exact system time can also be transmitted, in order to ensure the synchronization of the individual modules with one another. At the same time, via the data bus system, data can be interchanged between adjacent printing units, in order to compensate for actual value differences between these or to minimize oscillations. In this way, adjacent printing units are able to control out deviations separately from a higher-order machine control system by including the current actual values from the adjacent module.

Advantageously, provision is additionally made for the module to have a connection for the transport of ink or damping solution. In particular in the case of damping solution, which is needed in all the inking units of the individual modules, it is expedient to make a central supply to all the modules possible. For this purpose, the individual modules have line connections through which the damping solution can be transported from one printing unit to the next. Thus, it is then sufficient if one printing unit module is connected to a damping solution supply, since the damping solution can be transported to the further printing units from this printing unit module.

In a particularly advantageous refinement of the invention, provision is made for the module to have a wire-free transmitting and receiving unit. If the individual modules are equipped with wire-free transmitting and receiving units, the electrical connections for data transmission can be reduced to a minimum, for example in safety-relevant areas, or they can be dispensed with entirely. The data is then transmitted between the individual modules only in a wire-free manner, so that complicated cabling of the individual printing units with one another becomes superfluous. In this case, the wire-free transmitting and receiving unit can be designed using extremely different technologies, which can also still be combined with one another. One possibility is, for example, to equip all the modules with W-LAN or Bluetooth technology, in order in this way to permit wireless communication between the modules. In addition, any other type of radio data transmission is in principle suitable, if it meets the requirements on a sufficiently high data transmission rate. If time-critical commands for controlling the modules, such as synchronization commands, also have to be transmitted via the wire-free connection, then the radio data transmission must also meet the requirements with respect to real-time transmission. In this case, the transmitting and receiving unit can also include a satellite navigation instrument (GPS). As a modification of this solution, there can also be only one satellite navigation instrument, if recourse is had to conventional cabling. The satellite navigation instrument is used for determining the position of the individual modules, in order in this way to permit the configuration of the entire machine by the higher-order machine control system.

In addition, provision is made for the module to have a connection to a pneumatic or hydraulic system. In addition to the possibility of providing each module with electric drives, pneumatic or hydraulic drives can also be used. Since, normally, some actuators on printing unit modules are actuated pneumatically, for example during a printing plate change, it must be possible for compressed air to be supplied to these actuators. For this purpose, the modules have connections for a pneumatic or hydraulic system in order to make compressed air or hydraulic oil available to the individual modules. It is therefore possible to be able to supply a plurality of modules from a single source, which means that each module does not need a dedicated pneumatic or hydraulic pressure generating system.

Moreover, it is of great advantage that the module has at least one transposition-safeguarded connection for a communication line. In order that no faults arising from erroneous cabling of control lines can occur during operation and during the configuration, it is expedient to provide at least the connections for the communication lines with transposition-safeguarded connections, for example those of different shapes. Therefore, the connections between the individual modules are protected against erroneous cabling, since each connection on a module can be connected only to the matching connection on a further module. For the service personnel, the construction of a press from a plurality of modules is made easier if the electric plug connections are designed to be safeguarded against transposition, since then erroneous connections between the individual modules can be prevented. Damage to the machine arising from erroneous cabling is therefore ruled out.

Other features which are considered as characteristic for the invention are set forth in the appended claims.

Although the invention is illustrated and described herein as embodied in a modular sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
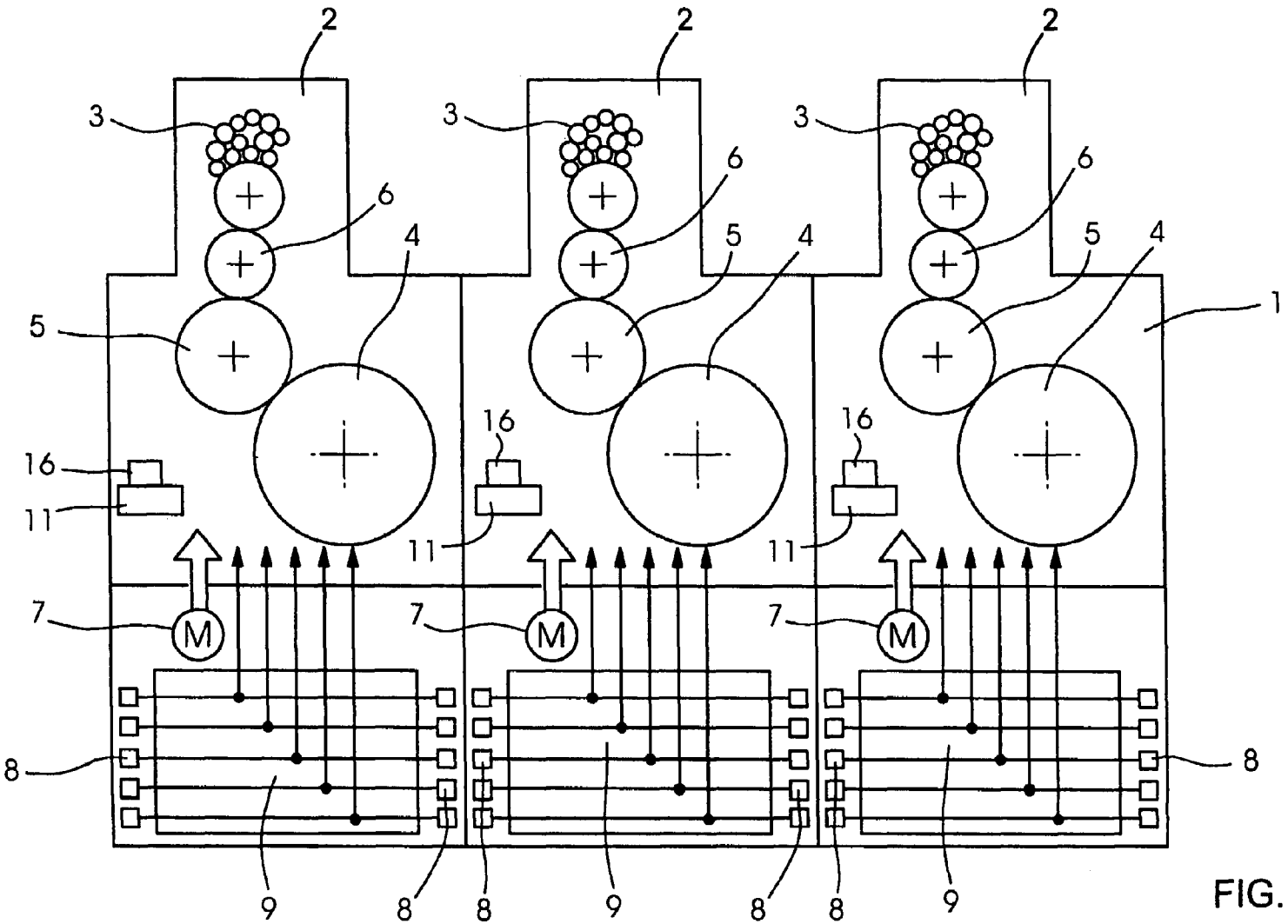
FIG. 1 is a diagrammatic side elevation of a press built up from three modules according to the invention.

Referring now to the figures of the drawing in detail and first, particularly, to FIG. 1 thereof, there is depicted a press 1 of modular construction. The printing machine has three printing units 2, the modules. The modules 2 shown in FIG. 1 are of identical construction in this case, this is not being absolutely necessary. It is merely important that the modules 2 have mutually compatible interfaces. Each modular printing unit 2 has an inking unit 3, which in each case applies printing ink to a plate cylinder 6. The plate cylinder 6 is operatively connected to a blanket cylinder 5, which prints sheet printing material resting on a transport cylinder 4. Each printing unit 2 is therefore an autonomous module. Each of the units 2, in an emergency, would also function as a single press 1 printing in one color. Furthermore, the modules 2 each have an electric drive motor 7, which either drives all the cylinders and other rotating components of a module 2 or is assisted by auxiliary electric units. These auxiliary motors can, for example, drive the inking unit 3 separately. Finally, the printing units 2 in FIG. 1 have a series of connections 8, via which the printing units 2 can be supplied with electric power, for example. Furthermore, there can be possible connections for feeding compressed air from a pneumatic system or hydraulic oil from a hydraulic system, which supply pneumatic or hydraulic actuators in the printing units 2. Each printing unit module 2 additionally has a printing unit computer 11, which controls all the electric drives 7 of the respective printing unit 2. The printing unit computer 11 is additionally connected to the bus and supply system 9 internal to the printing unit, so that it can communicate with adjacent printing units 2 or a higher-order control computer. The connections 8 have appropriate data interfaces for this purpose, with which the various printing units 2 can be coupled to one another via the bus system 9.

In the embodiment according to FIG. 1, there is also a transmitting and receiving unit 16 in each printing unit 2 as well, which is linked to the printing unit computer 11. This transmitting and receiving unit 16 operates without wires and is likewise used for networking the individual modules 2 with one another and with higher-order computers. In this case, it is expedient for a satellite navigation receiver (GPS)

also to be integrated in the transmitting and receiving unit 16, in order to be able to determine the position of the individual printing units 2 and therefore the order of the individual printing units 2. The local information with respect to the individual modules 2 can be used in particular during the automatic configuration and commissioning of the machine 1. Alternatively, the differences in the propagation times of the signals via the wire-free radio connection between the individual modules 2 could also be used for position detection since there is a different propagation time, depending on the distance between the modules 2. By means of logical combination of the propagation times determined between the modules 2, it is possible to draw conclusions about the overall configuration of the press 1 comprising the modules 2.

The individual printing units 2 can receive their rotational speed or angle set points via the bus and supply system 9, or control commands, which are converted into appropriate set points in the printing unit computers 11 of the respective modules 2, are transmitted via the bus system 9. Furthermore, the bus system 9 contains a separate line, by means of which the exact system time (clock) is transmitted to the individual modules 2. By means of this system time, the synchronization of the movement of the electric drives 7 of all the modules 2 with a virtual line shaft is made possible, which leads to the avoidance of oscillations in the case of long machines 1 having very many, for example 16, modules 2. Via the bus system 9, the individual printing units can also interchange data in order, for example, to be able to control out differences in angle between adjacent printing units separately from other commands. Moreover, at least in critical modules 2, what are known as safety channels are integrated into the bus system 9, which permit a fault on these channels to be detected reliably. Safety channels transmit data in parallel on at least two channels, so that the transmitted data can be checked for deviations. If such a fault occurs, the affected module 2 is brought to a secure state, for example stopped, under the control either of its own printing unit computer 11 or of the higher-order control computer 10. In addition, an alarm can be triggered.

Figure 2:
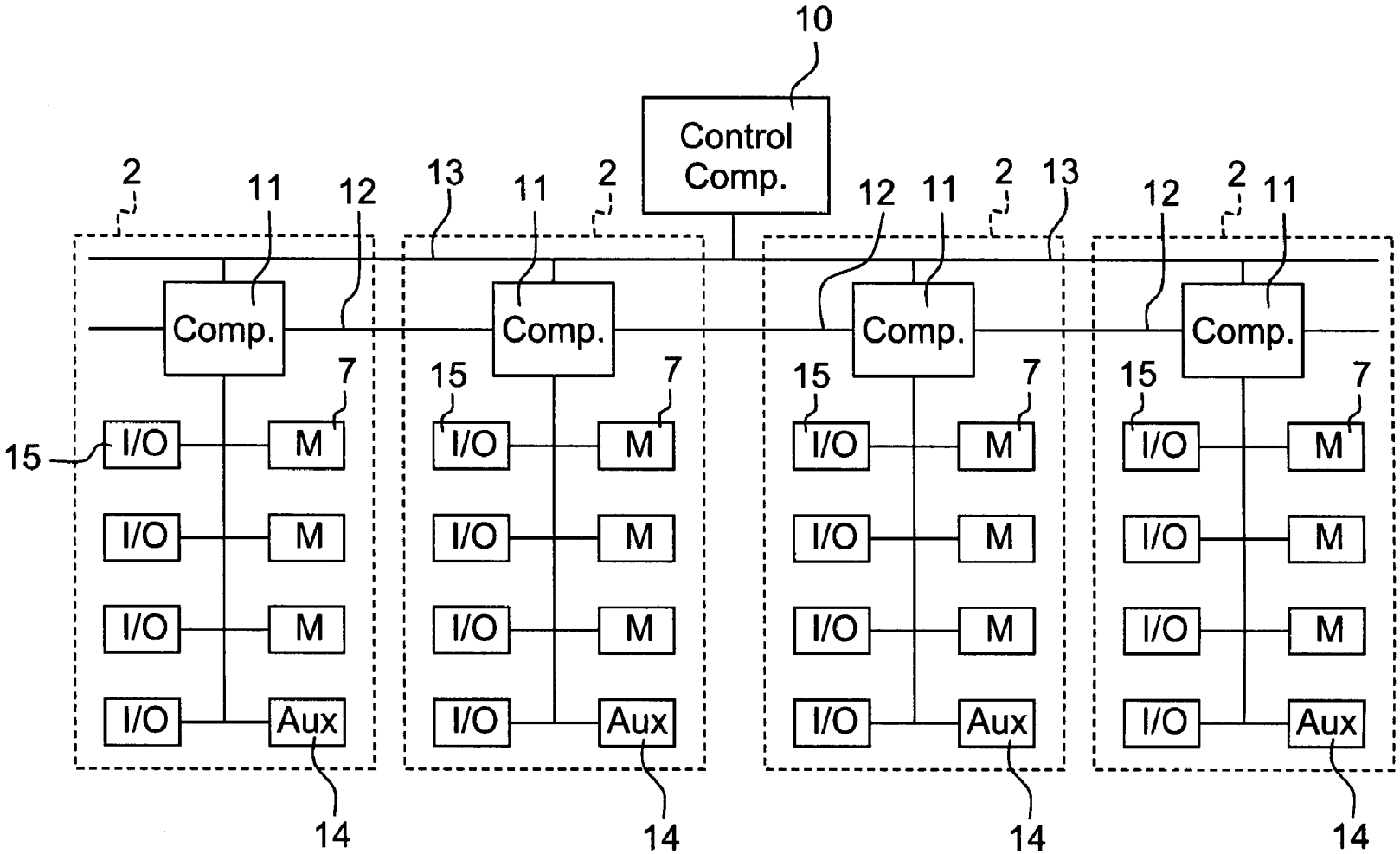
FIG. 2 is a block diagram illustrating a modular press.

FIG. 2 shows a circuit diagram in the overview of a modularly constructed press 1 which comprises four modules 2. Thus, the circuit diagram in FIG. 2 shows four printing unit computers 11 (COMP), which are connected to one another via data lines 12 by means of a bus and supply system 9 and the connections 8. These data lines 12 between the printing unit computers are optional in this case. It is necessary, on the other hand, for the data lines 13 to be present between the printing unit computers 11 and a higher-order control computer 10. This is because the control unit computer 10 coordinates the movement of the individual modules 2 via the bus system 9. The printing unit computers 11 control the individual drive motors 7 (M) by way of an associated input and output unit 15. In addition to the drive motors 7 shown in FIG. 2, still further components 14 can be controlled by the printing unit computers 11. These further components 14 are, for example, auxiliary drives for the inking unit 3, actuators for opening the grippers on the transport cylinder 4, washing systems on the cylinders, or other adjustment elements. All of these further components are summarily identified by the label AUX. The central control computer 10 can in this case be accommodated in a separate control desk but it can also be permanently installed on a specific module 2 or can be designed such that it can be plugged in interchangeably, so that it can be plugged into any desired module 2. The control computer 10 is responsible for the overall states of the machine 1, that is to say it starts the machine 1, it initiates the printing operations, it controls the printing speed and stops the machine 1 in the event of an emergency stop. However, the accurate regulation of the movable components in the individual modules 2 is carried out locally in the printing unit computers 11.

If a press 1 is to be started up, then the control computer 10 initially interrogates the individual modules 2. The data stored in the printing unit computer 11 about the properties of the associated module 2 is transmitted to the control computer 10, so that the latter can determine the configuration of the press 1. Such data includes, for example, the type and properties of the modules 2. As a result of interrogating the data, the control computer 10 calculates the overall configuration and, for example, determines the number of printing units/modules 2. These can be very different. For example, on one day, the press 1 may comprise three printing units 2 according to FIG. 1 then, on the next day, four printing units 2 as in FIG. 2. Since the press 1 in each case determines the current configuration at start-up, the press 1 automatically operates as a three-color machine on the one day and as a four-color machine on the other day. In addition to the printing units 2 mentioned in FIGS. 1 and 2, the modules 2 can also be feeders, deliveries, varnishing units, dryer modules or post-processing units such as punches, and so on. It is also possible for specific printing units 2 to be designed differently from other printing units 2, so that, for example, one printing unit can be equipped with a DI imaging unit (plate imaging in the printing unit). The data necessary for the imaging in this case can then be transmitted via the bus system 9, if the latter is designed as a high speed bus system. Via this high speed bus system, the digital data from the prepress stage can be transmitted directly to the DI imaging unit in the printing unit 2.

Figure 3:
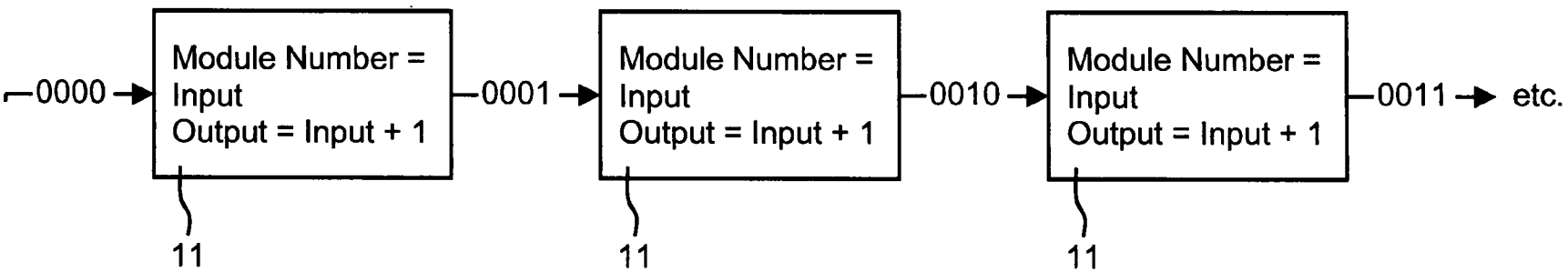
FIG. 3 is a basic flow chart illustrating a method of configuring a modular press.

FIG. 3 illustrates the configuration operation during the commissioning of a modular press 1 comprising three modules 2 with three printing unit computers 11, which are set up after one another in a row. Furthermore, for example by means of the transposition-safeguarded connections in conjunction with correspondingly short electric leads, it is ensured that the modules are connected correctly to one another and, in particular, no module can be left out during the cabling. During the numbering operation, a binary number on each printing unit computer 11 is increased by 1 as compared between input and output. In this way, the printing units 2 are numbered consecutively one after another, so that they can be identified unambiguously by the control computer 10 and the position of the respective printing unit 2 is also known to the control computer 10.

This application claims the priority, under 35 U.S.C. § 119, of German patent application No. 103 57 429.8, filed Dec. 9, 2003; the entire disclosure of the prior application is herewith incorporated by reference.

We claim:

1. A module for a machine for processing sheet printing materials, comprising:

interfaces for control communication;

a memory unit containing information concerning capabilities of the module and configured with read and write access; and a communications device, operatively connected to said memory unit, and configured for communication with at least one of a further module and a higher-order control system of the machine; the at least one module being an individual printing unit able to determine the position of the individual printing unit, as well as the positions of other individual printing units, and therefore determine the order of the individual printing unit and the other individual printing units of the printing press; and local information regarding the position of the individual printing units being used during automatic configuration and commissioning of the machine.

2. The module according to claim 1, wherein said communications device is configured for interchanging data with further modules for configuring the machine.

3. The module according to claim 1, wherein said interfaces includes at least one standardized transport interface.

4. The module according to claim 1, wherein said interfaces include at least one power supply interface.

5. The module according to claim 1, which comprises a dedicated drive motor for the module.

6. The module accorclirig to claim 1, wherein the module has at least one drive interface.

7. The module according to claim 6, wherein said drive interface is a shaft end provided with a coupling.

8. The module according to claim 1 configured with an automatic detection and configuration function.

9. The module according to claim 4, wherein said power supply interface includes mains power sockets mounted to the module.

10. The module according to claim 1, wherein said interfaces include a connection for the module for attachment to a data bus system.

11. The module according to claim 1, wherein said interfaces include a connection for transporting ink or damping solution.

12. The module according to claim 2, wherein said interfaces include a wire-free transmitting and receiving unit.

13. The module according to claim 1, wherein said interfaces include a satellite navigation unit.

14. The module according to claim 1, wherein said interfaces include a connection to a pneumatic or hydraulic system.

15. The module according to claim 1, wherein said interfaces include at least one transposition-safeguarded connection for a communication line.

16. A printing press, comprising:

at least two modules, each module being configured in accordance with the module of claim 1.

17. A method for configuring a sheet-fed printing press having at least one module that is an individual printing units, comprising the steps of:

providing the at least one module with a memory unit configured for read and write access, the memory unit containing information about the properties of the at least one module;

with the at least one module, determining the position of the individual printing units and the order of the individual printing units during automatic configuration and commissioning of the printing press.

* * * * *

UNITED STATES PATENT AND TRADEMARK OFFICE

CERTIFICATE OF CORRECTION

PATENT NO. : 7,331,289 B2
APPLICATION NO. : 11/007999
DATED : February 19, 2008
INVENTOR(S) : Kai Albrecht et al.

It is certified that error appears in the above-identified patent and that said Letters Patent is hereby corrected as shown below:

Title page, Item (73) should read as follows:

-- (73) Assignee: Heidelberger Druckmaschinen AG,
Heidelberg (DE) --

Column 9,

Line 16, "accorclirig" should read -- according --

Column 10,

Line 1, "The module according to claim 2," should read -- The module according to claim 1, --

Line 18, "individual printing units" should read -- individual printing unit --

Signed and Sealed this

Nineteenth Day of January, 2010

David J. Kappos

David J. Kappos
*Director of the United States Patent and Trademark Office*